US009334089B2

(12) United States Patent
Cardia

(10) Patent No.: US 9,334,089 B2
(45) Date of Patent: May 10, 2016

(54) DEVICE FOR THE CONTROLLED DELIVERY OF FLUIDS

(71) Applicant: Ennio Cardia, Rome (IT)

(72) Inventor: Ennio Cardia, Rome (IT)

( * ) Notice: Subject to any disclaimer, the term of this patent is extended or adjusted under 35 U.S.C. 154(b) by 61 days.

(21) Appl. No.: 14/384,868

(22) PCT Filed: Apr. 17, 2013

(86) PCT No.: PCT/IT2013/000111
§ 371 (c)(1),
(2) Date: Sep. 12, 2014

(87) PCT Pub. No.: WO2013/157027
PCT Pub. Date: Oct. 24, 2013

(65) Prior Publication Data

US 2015/0053723 A1 Feb. 26, 2015

(30) Foreign Application Priority Data

Apr. 17, 2012 (IT) ..... RM2012A0163

(51) Int. Cl.
*B65D 37/00* (2006.01)
*B65D 47/20* (2006.01)
*B65D 47/04* (2006.01)

(52) U.S. Cl.
CPC ..... *B65D 47/2018* (2013.01); *B65D 47/043* (2013.01)

(58) Field of Classification Search
CPC .. B65D 47/2018; B65D 47/043; B67D 7/166; G01F 11/286
USPC ..... 222/205–207, 209, 212, 454–456, 547, 222/562, 564
See application file for complete search history.

(56) References Cited

U.S. PATENT DOCUMENTS 2,977,028 A * 3/1961 Joffe ..... G01F 11/262 222/442
5,407,105 A * 4/1995 Santagiuliana ..... G01F 11/263 222/425
5,427,279 A * 6/1995 Kaufman ..... A47K 5/1211 222/207
6,837,402 B2 1/2005 Cardia
6,892,905 B2 * 5/2005 Cousseau ..... G01F 11/262 222/438

FOREIGN PATENT DOCUMENTS

EP 1 114 778 A1 7/2001
EP 1 237 812 B1 9/2002
WO 01/46065 A2 6/2001
WO 0146065 6/2001

OTHER PUBLICATIONS

International Search Report, dated Jul. 31, 2013, from corresponding PCT application.

* cited by examiner

*Primary Examiner* — Lien Ngo
(74) *Attorney, Agent, or Firm* — Young & Thompson

(57) ABSTRACT

A delivery device for coupling to the mouth of a container, for controlled delivery of fluids and/or flowing substances, includes an inlet opening, an outlet opening and a substantially "S" shaped delivery path connecting the inlet and outlet openings. The path includes a first conduit having one end corresponding to the inlet opening within the container, a second conduit, communicating with the first conduit, and a third conduit, communicating with the second conduit having one end corresponding to the outlet opening. The first and second conduits are ring-shaped, the first conduit externally embraces the second conduit and the second conduit externally embraces the third conduit, the first conduit being subdivided in a plurality of channels. A ring-shaped chamber surrounds the first conduit, and a ring-shaped stop element for the inlet opening, forms a ring-shaped fourth conduit communicating with the inlet opening and the first conduit, together forming a two-curve path.

16 Claims, 3 Drawing Sheets

DEVICE FOR THE CONTROLLED DELIVERY OF FLUIDS

The present invention relates to a device for controlled delivery of fluids.

More specifically, the present invention relates to a device for controlled delivery of fluids such as liquids or other flowing substances, such as bottles, e.g. sport beverages.

At present, bottles for liquids are available on the market, particularly for water or beverages, the caps of which are provided on a delivery device easing controlled delivery of liquid contained therein. Said delivery device prevents non desiderata outlet, permitting dosing water flow.

A known solution provides a thin silicone membrane having a plurality of cuts in correspondence of the container opening. When the elastically bottle deformable body is compressed, membrane opens and water is pushed toward the opening thus easing its consumption by the user of the liquid. Membrane closes again following release of pressure on bottle body.

In standard conditions, membrane is closed, preventing exit of the liquid even if the container is shaken.

A disadvantage of said known device is due to high manufacturing costs, particularly caused by the use of silicone. Further, said known delivery device causes a liquid jet under high and uniform pressure, which is uncomfortable for the user, which is not able to adjust pressure of the jet.

EP 1 237 812 describes a device for controlled delivery of fluids such as liquids and flowing substances, applied on the container cap in correspondence of its mouth. Said delivery device provides a flow delivery path the flow inlet opening of which has a surface lower than the container mouth and is in a lateral position close to the periphery of the delivery device. Aid delivery path has a S shape and provides a first conduct, having one end corresponding to the inlet opening of the fluid within the container, a second conduct, communicating with the first conduct, in a direction opposed with respect to the direction of the first one, and a third conduct, communicating with the second one and oriented according to a direction opposed with respect to the second conduct, wherein its end corresponds with outlet flow delivery opening.

Said delivery device, although without closure element for the conduct, prevents outlet of the fluid from delivery outlet opening, when the container is rotated of about 180°, before squeezing the container to deliver fluid.

Solution according to EP'812 has the advantage of being comprised only of two components without the third silicone component, that is a very expensive material, beside that of being manufactured with very low costs with respect to the known delivery device described in the above. Further, it permits a controlled delivery of fluids, permitting to the user to dose outlet pressure of said fluid, between a jet with a high pressure and a droplet delivery.

However, said delivery device has the disadvantage of behaving very well only when it is rotated at about 180°, and mainly when it is rotated in the sole polar direction of the S shaped delivery path (from inlet opening of the outlet delivery opening). In the other polar upturning directions, even ensuring a good sealing, it exists the possibility of a fluid exit, not ensuring a full sealing of the container in every situation.

Further, in case container is shacked in the polar position at about 180° or about 90° of the S shaped delivery path, delivery device cannot prevent exit of fluid amounts, even if minimum amounts.

Further, European patent application EP 1 114 778 A1 describes a delivery device to be applied to the mouth of a liquid container, provided with an exit opening closed by three annular conducts, provided in such a way to realise a siphon cap. When container body is compressed, it deforms permitting to the liquid to be delivered by the delivery device.

However, device described in EP'778 is not efficient, since during its rotation from 0° to 180° of the same container, it lost liquid also when it is not compressed. It occurs when, during its rotation, it passes to the 90° position, outer air enters within said container through the upper zone of the of three auxiliary conducts, partially annulling inner air negative pression caused from useful siphon effect.

Object of the present invention is that of overcoming the drawbacks of the above known solutions, and particularly of solutions according to European patent EP 1 237 812 and European patent application EP 1 114 778 A1, suggesting a delivery device for controlled delivery of fluids such as liquids or flowing substances regardless the polar rotation direction of the container to deliver the fluid, from 0° to 360°, and under every use condition, even if shacked.

Another object of the present invention is that of providing a solution permitting to the user dosing fluid outlet pressure and reduced manufacturing costs.

Therefore, it is object of the present invention a delivery device for the controlled delivery of fluids and/or flowing substances, said device being able to be coupled to the mouth of an elastically deformable container, said delivery device comprising an inlet opening for the fluid, in correspondence with said mouth, an outlet opening for the fluid and a substantially "S" shaped delivery path able to connect said inlet opening with said outlet opening, said substantially "S" shaped path comprising a first conduit or inlet conduit, wherein one of its ends corresponds to the inlet opening for the fluid from within said container, a second conduit or intermediate reverse conduit, communicating with the first conduit and oriented towards its opposite direction, and a third conduit or outlet conduit, communicating with the second conduit and oriented towards its opposite direction, wherein one of its ends corresponds to the outlet opening for the fluid, said delivery device being characterized in that said first and second conduits are ring-shaped, wherein said first conduit externally embraces said second conduit and said second conduit externally embraces said third conduit, said first conduct is subdivided in a plurality of channels or micro channels, in that it further comprises a ring-shaped chamber, said ring-shaped chamber surrounding said first conduit, and in that it comprises a ring-shaped stop element in correspondence of said inlet opening, suitable for reducing the outflow of the fluid, and able to form a ring-shaped fourth conduit or peripheral conduit, said fourth conduit communicating with said inlet opening and said first conduit, together forming a two-curves path.

Further, according to the invention, said second conduit can be subdivided in a plurality of channels.

Still according to the invention, said third conduit is subdivided in a plurality of channels.

Always according to the invention, said first conduit can have a height lower than said second conduit.

Particularly, according to the invention, said first conduit can have a height substantially equivalent to the half of the height of the second conduit.

Furthermore according to the invention, said third conduit can have a height lower than said second conduit.

Preferably according to the invention, said third conduit can have a height substantially included within the range between the half and two-thirds of the height of the second conduit.

Otherwise, according to the invention, said fourth conduit can have a two-steps cross-section, said two-steps cross-section being divided in a first portion, communicating with said ring-shaped inlet opening, and a ring-shaped second portion, being intermediate between said first portion and said first conduit, said second portion having a diameter smaller than said first portion and bigger than said first conduit.

Further according to the invention, said first portion of said fourth conduit can be subdivided in a plurality of channels or micro-channels.

Preferably according to the invention, said second portion of said fourth conduit is subdivided in a plurality of channels or micro-channels.

Furthermore, according to the invention, said stop element can comprise a further ring-shaped auxiliary chamber, circumscribed by said fourth conduit and opened towards said inlet opening.

Still according to the invention, outflow of the fluid determined by the cross-section of the first conduit or inlet conduit is substantially equal to the outflow of the fluid determined by the third conduit or outlet conduit, even if said first and third conduits have cross-sections of different shapes.

Always according to the invention, said micro-channels of said first conduct can be divided by one or more annular grooves, extending transversally with respect to the fluid passage direction, dividing said micro-channels into two or more circular assemblies, rotated each other, alternate, so as to create zigzag paths for fluid to be delivery.

Finally, according to the invention, said third conduct can be in a central position with respect to said second conduct.

The invention will be described in the following for illustrative, but not limitative purposes, with particular reference to the drawings of the enclosed figures, wherein:

FIG. 1 shows a front view of a first embodiment of delivery device according to the invention applied to a container rotated at 180°;

FIG. 1*a* shows a front section view of delivery device of FIG. 1;

FIG. 2 shows a front section view of delivery device of FIG. 1 applied to a container rotated at 90°;

FIG. 2*a* shows a front section view of delivery device of FIG. 2;

FIG. 2*b* shows a front section view of a particular of FIG. 2*a;*

FIG. 3 shows a front section view of delivery device of FIG. 1 applied to a container in an upstanding position;

FIG. 3*a* shows a front section view of delivery device of FIG. 3;

Figure 12:
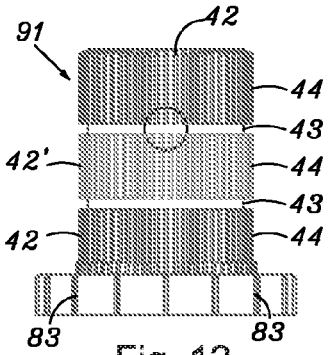
FIG. 12 shows a front view of inner component of second embodiment of delivery device according to the invention.
Figure 13A:
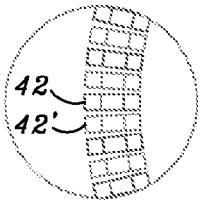
Figure 13:
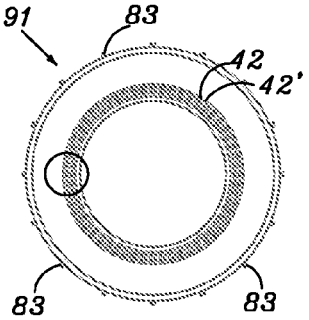
Figure 14:
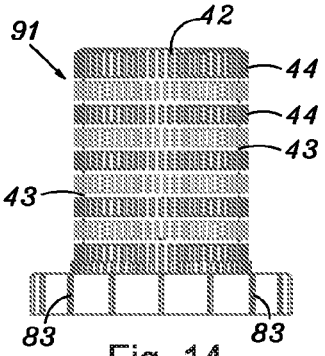
Figure 12A:
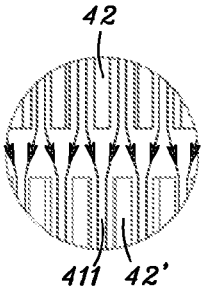
Figure 15:
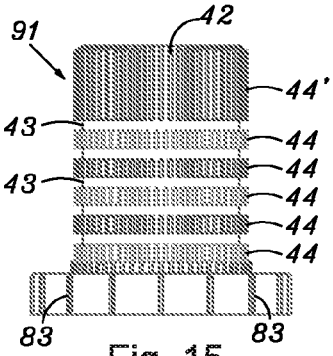
Figure 16:
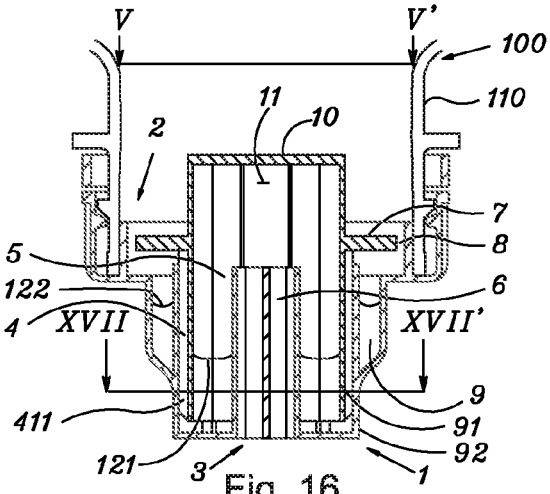
Figure 17:
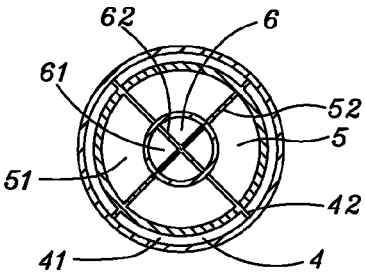

FIG. 12*a* shows a front view of a particular of FIG. 12, putting into evidence zigzag paths of fluid to be delivered;

FIG. 13 shows a top view of inner component of delivery device of FIG. 12;

FIG. 13*a* shows a top view of a particular of a detail of FIG. 13;

FIG. 14 shows a front view of inner component of third embodiment of delivery device according to the invention;

FIG. 15 shows a front view of inner component of fourth embodiment of delivery device according to the invention;

FIG. 16 shows a front section view of fourth embodiment of delivery device according to the invention; and FIG. 17 shows a cross section view taken along line XVII-XVII' of delivery device of FIG. 16.

Making reference to FIGS. 1-5, it is noted a first embodiment of delivery device according to the invention, generically indicated by reference number 1. Said delivery device 1 for controlled delivery of substances to be delivered, provided with a bottom 10, is removably coupled with mouth 110 of a fluid container 100.

Said fluids to be delivered can be substances such as liquids, creamy substances and/or flowing substances.

Said fluid container 100 has an elastically deformable body, with a suitable elastic memory, and can be a tube or a bottle.

Figure 4:
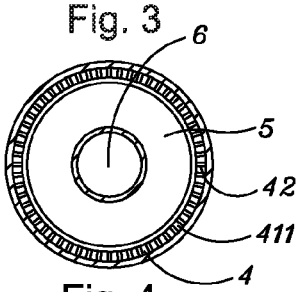
FIG. 4 shows a cross-section view taken along line IV-IV of delivery device of FIG. 1*a;*

Particularly, said delivery device 1 has a fluid inlet opening 2, in correspondence of the mouth 110 of said container 100, and an outlet opening 3 for delivering the fluid, centrally provided with respect to said delivery device 1. Said inlet 2 and outlet 3 openings are connected by a substantially S shaped delivery path, comprised of an inner component 91 and an outer component 92 of said delivery device 1. Said S shaped delivery path comprises a first conduct 4 or inlet conduct, an end of which corresponds to the inlet opening 2 of fluid arriving from inside the container 100, a second conduct 5, or inversion intermediate conduct, communicating with the first conduct 4 and oriented in a direction opposed with respect to the same, wherein its free end corresponds with the fluid delivery outlet opening 3. Particularly, as shown in FIG. 4, said third conduct 6 is centrally positioned with respect to said delivery device 1, being outside surrounded by said second conduct 5, having a circular ring shape. Said third conduct 6 has a height lower than the height of said second conduct 5, particularly having a height substantially comprised between the half and two-third of the height of the second conduct 5.

Finally, said first conduct 4 has a circular ring extension, externally surrounding the second conduct 5 and having a height lower than that of said second conduct 5, particularly within the range between substantially the half and 85% of the height of said second conduct 5.

Figure 1A:
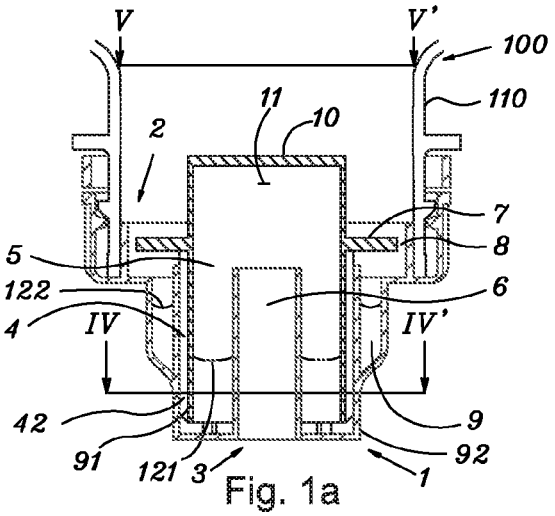
Figure 1:
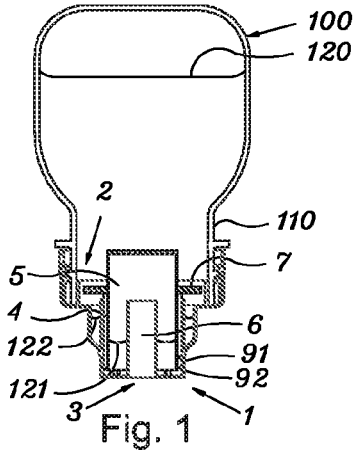
Figure 2:
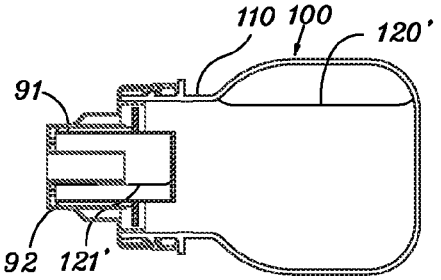
Figure 3A:
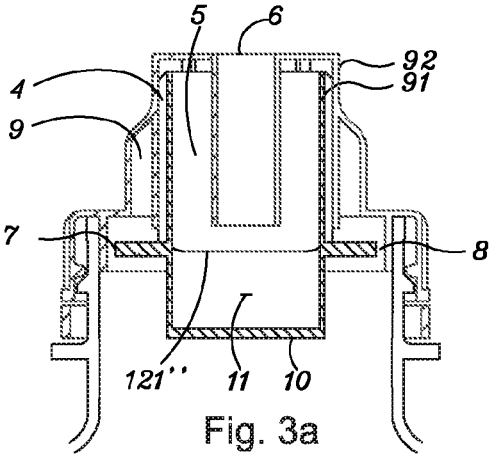
Figure 3:
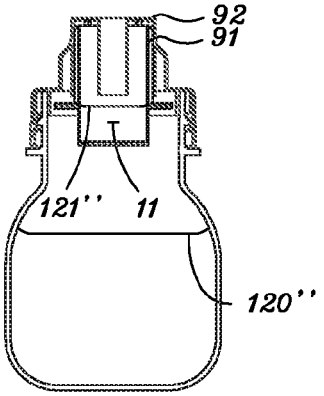
Figure 5:
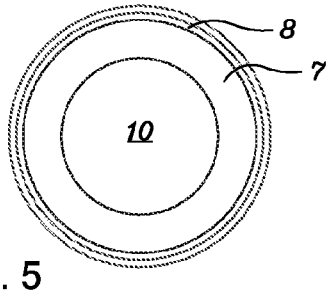
FIG. 5 shows a cross-section view taken along line V-V of delivery device of FIG. 1*a;*
Figure 2A:
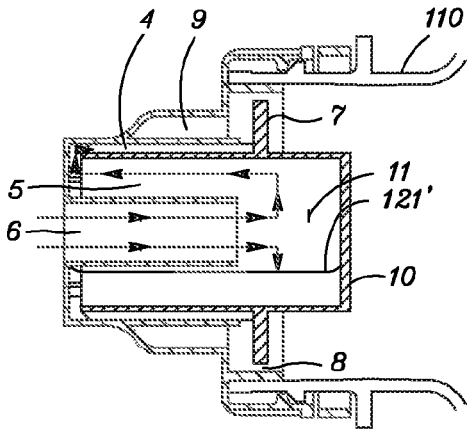

Said second conduct or inversion conduct 5 has a height large than said third conduct or outlet conduct 6, in order to realise a storage recipient 11 for fluid 121 eventually not discharged after delivery during the suck action, or for fluid 121' remained within said inversion conduct 5 during the short rotation return movement from 180° (container with delivery device faced downward, as shown in FIGS. 1 and 1*a*) to 90° (container having delivery device parallel with respect to the resting surface, as shown in FIGS. 2 and 2*a*) or for fluid 121" remained within the inversion conduct 5 during the rotation movement from 90° to 0° (container in an upstanding position, as shown in FIGS. 3 and 3*a*).

In the 0° position of said container 110, fluid 121" level within storage recipient 11 remains sufficiently spaced from the inner end of the third conduct or outlet conduct 6, so that outward air passages can freely circulate within S shaped path of delivery device 1, without meeting said not discharged fluid within the storage recipient.

Said arrangement advantageously permits upturning said container 100 on which the delivery device 1 according to the invention is applied, without exit of the fluid.

When the container is turned upside down of 180° for a subsequent delivery of the contained fluid 120, the fluid 121 stored in the storage recipient 11 is collected in the opposite side of the inversion conduit 5, joining the rest of the fluid to deliver.

In fact, by pressure exerted on fluid container under pressure passes through said S shaped path, permitting to the user a controlled jet or droplet delivery of fluid contained, such as liquid or flowing substance.

On the contrary, even if container is accidentally or voluntarily upturned, fluid contained within the container passes through, by gravity, the first conduct 4, stopping within the second conduct 5 by the action of outer pressure of air arriving from third conduct 6 (level of fluid 121 due to 180° rotation, level of fluid 121' due to 90° rotation, as shown in FIGS. 1*a* and 2*a*).

Only by means of the pressure of the elastically deformable body of said container is possible to initiate the fluid delivery.

Said effect is due to the fact that inner pressure of inner air volume enclosed and insulated within container 100, is always more negative with respect to said atmospheric pressure of outer air, while inner fluid enclosed within the container lowers the level, thus causing an increase of inner air volume, for passage of said fluid, without a corresponding opposed air passage, within the first conduct 4, and part of the second conduct 5 of S shaped path.

Fluid passage stops (fluid level 121) in said second conduct 5 when outer pressure, plus pressure of liquid column (fluid level 121) in said second conduct 5 is dynamically balanced with negative inner pressure, plus pressure of liquid column height within the first conduct 4 and container 100 (fluid level 120), with features similar to those described in European Patent EP 1 237 812.

Further, said first conduct 4 is divided by a plurality of first septa 42 into a plurality of micro-channels 411, substantially having the same dimensions.

Figure 2B:
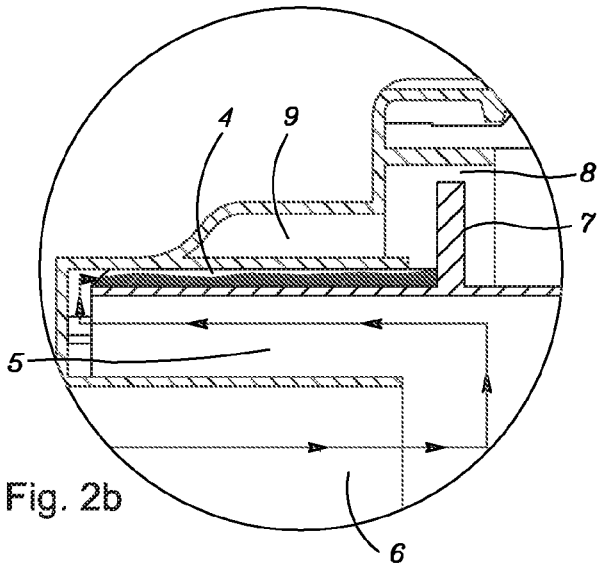

Said micro-channels 411 of first conduct 4 advantageously permit when delivery device is in the 90° position (parallel with respect to the resting surface, shown in FIGS. 2, 2*a* and 2*b*), a better control of preventing the opposed inlet of air within micro-channels 411 while passing through the first conduct 4, so as to ensure a sufficient reduction of pressure in air volume enclosed within the container 100, thus permitting to the user to much more easily control fluid delivery by pressure on container 100 body.

Presence of micro-channels 411, having such dimensions to permit to the fluid flowing, in function of its density, permitting that, following the first delivery, after the suck action, a part of the fluid remains trapped by surface tension within said micro-channels 411, so that fluid stagnation veil within micro-channel is sufficiently able to prevent passage of outer air toward inside the container, thus interrupting passage of outer air along siphon S shaped path provided on the upper part when it is at 90°, or passes at)=à when rotating from 0° to 180°.

Further, said delivery device 1 comprises a ring-shaped chamber 9, surrounding said first conduct 4 and communicating both with said first conduct 4 and with inlet opening 2 of said delivery device 1.

Said ring-shaped chamber 9 has the function of auxiliary chamber to contain fluid (fluid level 122, FIGS. 1 and 1*a*) when container 100 is rotated or upturned, reducing the amount of fluid to be emptied, collected within the second conduct 5, following the air sucking action after the end of the delivery action.

Presence of said annular chamber 9 permits reducing height of said storage recipient 11, or to increase length of said third conduct or outlet conduct 6, in order to better reduce unwished outlet of fluid (fluid level 121) when said container is in an upturned position at 180°, with the delivery device 1 faced downward.

Finally, said delivery device 1 further comprises a ring shaped stop element 7, to reduce outflow of fluid through inlet opening 2. Particularly, said stop element 7 realises a fourth conduct 8, or peripheral conduct, positioned along the peripheral part of said inlet opening 2 and having a circular ring extension. Said fourth conduct 8 communicates both with said inlet opening 2 and said first conduct 4, so as to realise a double curve path. Said fourth conduct 8 is further communicating with said annular chamber 9.

Presence of said stop element 7 advantageously permits preventing exit of fluid when container is shacked, particularly if upturned with fluid outlet opening faced downward.

Further, containment of fluid (fluid level 122, FIGS. 1 and 1*a*) collected within said annular chamber 9 is easily emptied by the sucking action when container 100 is again rotated or upturned to go back to the 0° position (upstanding position, FIGS. 3 and 3*a*) through fourth conduct 8, or peripheral conduct, positioned along the peripheral portion of said inlet opening 2 and having a circular ring extension, said fourth conduct 8 or peripheral conduct being faced downward, when container 100 is in said upstanding 0° position.

The same reference will be used in the following FIGS. 6-17 when referring to the same components of the delivery device described in the above.

In a preferred embodiment of said first septa 42 of said first conduct 4 are fifty-six with a thickness of 0.3 mm, a width between 0.75 mm and 0.8 mm and a height between 14.50 and 18.40 mm; said second septa 83 of said fourth conduct 8 have a width between 0.30 mm and 0.40 mm; height of said third conduct 6 is between 16.40 mm and 17.50 mm; height difference between said third 6 and second 5 conducts is included within the range 7.24 mm and 6.14 mm.

Particularly, flow section of fluid passing through said first conduct 4 cannot be lower than the fluid flow section of outlet opening 3 or preferably equal to or a little bigger than said fluid flow section of the outlet opening 3.

Figure 6:
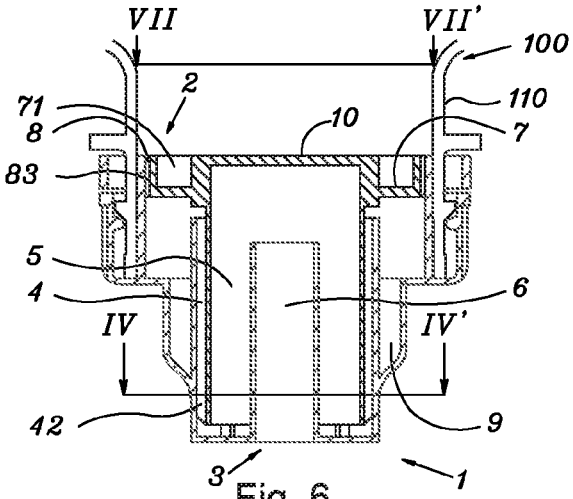
FIG. 6 shows a front view of a second embodiment of delivery device according to the invention.
Figure 7:
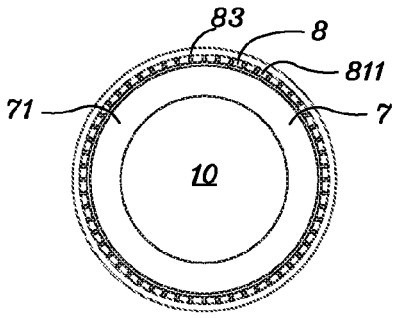
FIG. 7 shows a cross-section view taken along line VII-VII' of delivery device of FIG. 6.

A second embodiment of delivery device 1 according to the invention is shown in FIGS. 6 and 7, wherein, differently from the device shown in FIGS. 1-5, said fourth conduct 8 is divided by a plurality of small septa 83 to realise a plurality of micro-channels 811. Further, in correspondence of said micro-channels 811, said stop element 7 comprises a further circular ring shaped auxiliary chamber 71, surrounded by said fourth conduct 8 and open toward the inlet opening 2.

Figure 8:
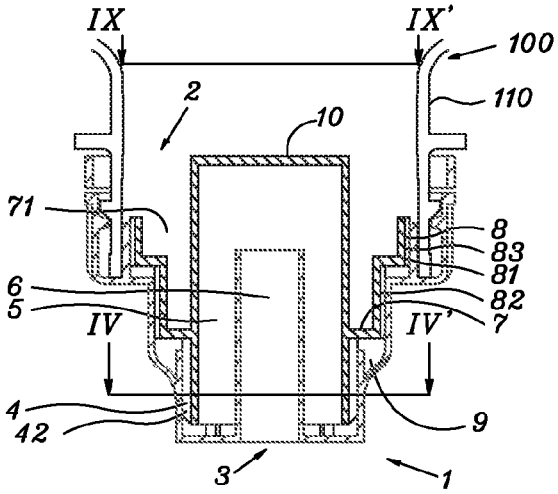
FIG. 8 shows a front view of a third embodiment of delivery device according to the invention.
Figure 9:
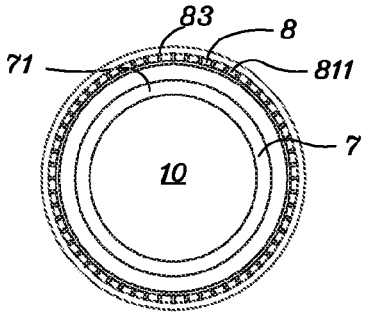
FIG. 9 shows a cross-section view taken along line IX-IX' of delivery device of FIG. 8.

Observing now FIGS. 8 and 9, it is shown a third embodiment of delivery device 1 according to the invention, wherein, differently with respect to the delivery device of FIGS. 6 and 7, said fourth conduct 8 has a double-step section, being it divided in a first portion 81, communicating with said inlet opening 2 and having a circular ring shape divided into a plurality of micro-channels 811, and a second portion 82, intermediate between said first portion 81 and said first conduct 4. Also said second portion 82 has a circular ring section, with a diameter lower than the first portion 81 and larger than the first conduct 4, divided in a plurality of micro-channels 811. In this embodiment too the stop element 7 comprises an circular ring auxiliary chamber 71 surrounded by said first 81 and second 82 portions of said fourth conduct 8.

Figure 10:
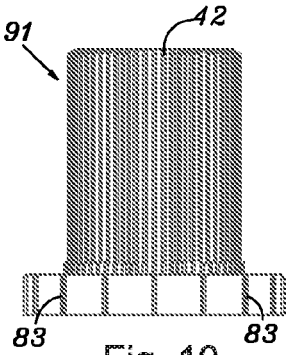
FIG. 10 shows a front view of inner component of first embodiment of delivery device according to the invention.
Figure 11:
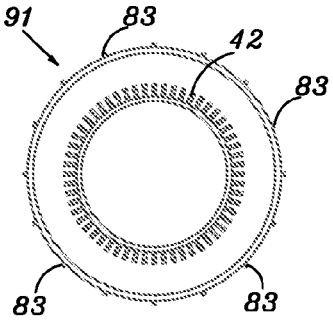
FIG. 11 shows a top view of inner component of delivery device of FIG. 10.

Making reference to FIGS. 10 and 11, it is shown a first embodiment of the inner component 91 of said delivery device 1 according to the invention, on which said first septa 42 of said first conduct 42 are obtained, as described in the above.

From FIGS. 12-15 they are observed other embodiments of the inner component 91, wherein septa 42 of said first conduct 4, instead being longitudinally continuous, are divided and spaced by one or more annular grooves 43, extending transversely with respect to the fluid passage direction (particularly two in FIG. 12, eight in FIG. 14 and five in FIG. 15), longitudinally dividing said septa 42, and thus said micro-channels 411 of said first conduct 4, into two or more circular assemblies 44, 44' (particularly three in FIG. 12, nine in FIG. 14 and six in FIG. 15).

Said circular assemblies 44 are alternately rotated each other of an angle of about 3°, particularly of 3.214286° when fifty-six septa 42 are provided, as in the embodiments shown, so that, on one side an end of a micro-channel 411 and on the other side the end of a septum 42 of the circular assembly 44 of following septa 42 face in correspondence of an annular groove 43.

In this way, fluid, passing through said micro-channels 411, follows a zigzag path (as shown in FIG. 12*a*), creating obstacles to the oscillatory shakings.

Particularly, in the embodiment shown in FIG. 15, a first circular assembly 44' is shown, with a longitudinal length bigger than other following circular assemblies 44 to ensure a sufficient longitudinal length of micro-channels 411, that can realise a fluid stagnation after the delivery action, suitable to ensure preventing passage of outer air toward inside the container along the siphon S shaped path.

Particularly, in embodiments shown in FIGS. 12-15, said circular assemblies 44, 44' have a height between 6.5 mm and 1.5 mm, and said annular grooves 43 has a height between 0.5 mm and 0.95 mm. In further embodiments, not shown in the figures, in the delivery device according to the invention, each one of said first, second, third and/or fourth conduct can be divided into a plurality of channels or micro-channels, on the basis of the density of fluid to be delivered. Particularly, in the embodiment shown in FIGS. 16 and 17, third conduct 6, or outlet conduct, is divided by four septa 42 into four channels 61, substantially having the same dimensions, the second conduct 5, or inversion intermediate conduct, is divided by four septa 52 into four channels 51*m* substantially having the same dimensions, and also first conduct 4, or inlet conduct, is divided by four septa 42 into four channels 41, substantially having the same dimensions.

Finally, in further embodiments, not shown, said delivery device can comprise said auxiliary containment annular chamber of flowing chambers in correspondence of said first conduct 4 and/or said stop element 7.

In the above, preferred embodiments of the present invention have been described, and variations have been suggested, but it is understood that one skilled in the art can introduce modifications and changes without departing from the relevant scope, as defined in the enclosed claims.

The invention claimed is:

1. A delivery device (1) for the controlled delivery of fluids and/or flowing substances, said device being able to be coupled to the mouth (110) of an elastically deformable container (100), said delivery device (1) comprising an inlet opening (2) for the fluid, in correspondence with said mouth (110), an outlet opening (3) for the fluid and a substantially "S" shaped delivery path able to connect said inlet opening (2) with said outlet opening (3), said substantially "S" shaped path comprising a first conduit (4) or inlet conduit, wherein one of its ends corresponds to the inlet opening (2) for the fluid from within said container (100), a second conduit (5) or intermediate reverse conduit, communicating with the first conduit (4) and oriented towards its opposite direction, and a third conduit (6) or outlet conduit, communicating with the second conduit (5) and oriented towards its opposite direction, wherein one of its ends corresponds to the outlet opening (3) for the fluid, said delivery device (1) being characterized in that said first (4) and second (5) conduits are ring-shaped, wherein said first conduit (4) externally embraces said second conduit (5) and said second conduit (5) externally embraces said third conduit (6), in that said first conduit (4) is subdivided in a plurality of channels (41) or micro-channels (411), in that it further comprises a ring-shaped chamber (9), said ring-shaped chamber (9) surrounding said first conduit (4), and in that it comprises a ring-shaped stop element (7) in correspondence of said inlet opening (2), suitable for reducing the outflow of the fluid, and able to form a ring-shaped fourth conduit (8) or peripheral conduit, said fourth conduit (8) communicating with said inlet opening (2) and said first conduit (4), together forming a two-curves path.

2. The delivery device (1) according to claim 1, characterized in that said second conduit (5) is subdivided in a plurality of channels (51).

3. The delivery device (1) according to claim 1, characterized in that said third conduit (6) is subdivided in a plurality of channels (61).

4. The delivery device (1) according to claim 1, characterized in that said first conduit (4) has a height lower than said second conduit (5).

5. The delivery device (1) according to claim 4, characterized in that said first conduit (4) has the height substantially equivalent to the half of the height of the second conduit (5).

6. The delivery device (1) according to claim 1, characterized in that said third conduit (6) has a height lower than said second conduit (5).

7. The delivery device (1) according to claim 6, characterized in that said third conduit (4) has the height substantially equivalent to the half of the height of the second conduit (5).

8. The delivery device (1) according to claim 1, characterized in that said fourth conduct (8) is divided in a plurality of channels or micro-channels (811).

9. The delivery device (1) according to claim 1, characterized in that said fourth conduit (8) has a two-steps cross-section, said two-steps cross-section being divided in a first portion (81), communicating with said ring-shaped inlet opening (2), and a ring-shaped second portion (82), being intermediate between said first portion (81) and said first conduit (4), said second portion (82) having a diameter smaller than said first portion (81) and bigger than said first conduit (4).

10. The delivery device (1) according to claim 9, characterized in that said first portion (81) of said fourth conduit (8) is subdivided in a plurality of channels or micro-channels (811).

11. The delivery device (1) according to claim 9, characterized in that said second portion (82) of said fourth conduit (8) is subdivided in a plurality of channels or micro-channels.

12. The delivery device (1) according to claim 1, characterized in that said stop element (7) comprises a further ring-shaped auxiliary chamber (71), circumscribed by said fourth conduit (8) and opened towards said inlet opening (2).

13. The delivery device (1) according to claim 1, characterized in that the outflow of the fluid determined by the cross-section of the first conduit (4) or inlet conduit is substantially equal to the outflow of the fluid determined by the third conduit (6) or outlet conduit, even if said first (4) and third (6) conduits have cross-sections of different shapes.

14. The delivery device (1) according to claim 1, characterized in that said micro-channels (411) of said first conduct (4) are divided by one or more annular grooves (43), extending transversally with respect to the fluid passage direction, dividing said micro-channels (411) into two or more circular assemblies (44), rotated each other, alternate, so as to create zigzag paths for fluid to be delivery.

15. The delivery device (1) according to claim 1, characterized in that said third conduct (6) is in a central position with respect to said second conduct (5).

16. The delivery device (1) according to claim 2, characterized in that said third conduit (6) is subdivided in a plurality of channels (61).

* * * * *